United States Patent [19]

Bates et al.

[11] Patent Number: 4,805,427

[45] Date of Patent: Feb. 21, 1989

[54] CENTRALIZED DOOR LOCKING SYSTEM

[75] Inventors: Trevor Bates; Graham Smith, both of Bedfordshire; Gary C. Fulks, Buckinghamshire, all of England

[73] Assignee: Delco Products Overseas Corporation, Detroit, Mich.

[21] Appl. No.: 42,395

[22] Filed: Apr. 24, 1987

[30] Foreign Application Priority Data

May 2, 1986 [GB] United Kingdom ..... 8610859

[51] Int. Cl.[4] ..... E05B 65/36

[52] U.S. Cl. ..... 70/264; 180/289; 292/DIG. 3; 292/DIG. 43

[58] Field of Search ..... 70/264, 279, 281; 292/201, DIG. 43, DIG. 29, 341.16, DIG. 3; 200/43.08; 180/289

[56] References Cited

U.S. PATENT DOCUMENTS

| | | | |
|---|---|---|---|
| 2,202,834 | 6/1940 | Clarkson-Jones | 70/264 |
| 2,470,581 | 5/1949 | Seaman | 70/264 |
| 2,499,727 | 3/1950 | Craig | 70/264 X |
| 2,765,648 | 10/1956 | Hatcher | 70/264 |
| 2,842,953 | 7/1958 | Troudt | 70/264 |
| 2,959,238 | 11/1960 | Dyer et al. | 70/264 |
| 2,996,910 | 8/1961 | Willis | 70/264 |
| 3,000,204 | 9/1961 | DeVito | 70/264 |
| 3,030,794 | 4/1962 | Dyer et al. | 70/264 |
| 3,386,761 | 6/1968 | Johnstone et al. | 292/201 |
| 3,612,207 | 10/1971 | Cabanes | 70/264 X |
| 3,653,237 | 4/1972 | DuRocher | 70/264 |
| 3,747,379 | 7/1973 | Cabanes | 70/264 |
| 4,342,209 | 8/1982 | Kleefeldt | 70/237 X |

FOREIGN PATENT DOCUMENTS

| | | | |
|---|---|---|---|
| 2941899 | 4/1981 | Fed. Rep. of Germany | 70/264 |
| 2946889 | 6/1981 | Fed. Rep. of Germany . | |
| 3006819 | 9/1981 | Fed. Rep. of Germany | 70/264 |
| 3413774 | 10/1985 | Fed. Rep. of Germany | 70/264 |
| 3413775 | 11/1985 | Fed. Rep. of Germany | 70/264 |
| 649708 | 9/1928 | France | 292/201 |
| 1036536 | 7/1966 | United Kingdom | 70/264 |
| 2058200 | 4/1981 | United Kingdom . | |
| 2159001 | 11/1985 | United Kingdom . | |

*Primary Examiner*—Lloyd A. Gall

*Attorney, Agent, or Firm*—Robert M. Sigler

[57] ABSTRACT

A centralized door-locking system in a motor vehicle in which all of the doors of the vehicle and a tailgate of the vehicle have lockable latches which can be locked/unlocked electrically using key-operable switches asociated with the lockable latches in the driver's door, front passenger's door and the tailgate of the vehicle. In the system, it is possible to selectively lock/unlock the driver's door and/or the tailgate independently of the remaining doors of the vehicle, thus improving the overall security against unauthorized entry to the vehicle by third persons during usage of the vehicle. This selective locking/unlocking of the driver's door and tailgate may be achieved by using, for example, a key-operable switch in the driver's door having a rotatable key barrel 32 with key slot 160 which is rotatable clockwise or anticlockwise from a central position N to sequential switching positions A and B, or C and D, against an increasing spring bias 162, 164. In such an arrangement, movement of the key slot 160 from position N to position A mechanically unlocks only the driver's door, whereas movement of the key slot from position A to position B electrically unlocks all of the doors and the tailgate of the vehicle.

5 Claims, 3 Drawing Sheets

CENTRALIZED DOOR LOCKING SYSTEM

BACKGROUND OF THE INVENTION

This inventon relates to centralized door-locking systems in motor vehicles, and, in particular, to a centralised door-locking system in a motor vehicle having a door for a driver of the vehicle, one or more doors providing access for passengers in the vehicle, and a tailgate providing access to a luggage compartment of the vehicle, in which system lockable latches are provided on all of the doors and on the tailgate, the lockable latches on at least the driver's door and the tailgate being key-operable lockable latches, and said lockable latches are interconnected by a switchable actuation system responsive to electrical signals generated by the key-operable lockable latches, said door-locking system being operable; (a) to lock all of the lockable latches in response to the actuation of the key-operable lockable latch of the driver's door in one direction using a key; (b) to unlock all of the lockable latches in response to actuation of the key-operable lockable latch of the driver's door in the opposite direction by said key; and (c) to lock all of the lockable latches in response to actuation of the key-operable lockable latch of the tailgate in one direction by said key.

In such a centralised door-locking system, it is possible to lock or unlock all of the doors and tailgate of a motor vehicle equipped with the system by the acutuation of the lockable latch of the driver's door using a key, and to lock all of the doors of the vehicle and the tailgate by actuation of the lockable latch of the tailgate with a key. Such a system is highly convenient to users of the vehicle, particularly when the vehicle is parked in an exposed position in bad weather conditions, or the vehicle has been parked and the last things to be removed from the vehicle comprise items from the luggage compartment of the vehicle.

However, the aforesaid centralised door-locking systems, convenient though they are, inevitably unlock all the doors of the vehicle when unlocking the driver's door, and this may not always be desired by the driver. The present invention overcomes this disadvantage by modifying such a centralised door-locking system so that a driver of the vehicle can selectively unlock the vehicle doors without losing any of the advantages of such a centralised door-locking system.

SUMMARY OF THE INVENTION

A centralised door-locking system according to the present invention, in a motor vehicle having a door for a driver of the vehicle, one or more doors providing access for passengers in the vehicle, and a tailgate providing access to a luggage compartment of the vehicle, comprises a system in which lockable latches are provided on all of the doors and on the tailgate, the lockable latches on the driver's door and the tailgate being key-operable lockable latches, and said lockable latches are interconnected by a switchable actuation system responsive to electrical signals generated by the key-operable lockable latches, said door-locking system being operable; (a) to lock all of the lockable latches in response to the actuation of the key-operable lockable latch of the driver's door in one direction using a key; (b) to unlock all of the lockable latches in response to actuation of the key-operable lockable latch of the driver's door in the opposite direction by said key; (c) to lock all of the lockable latches in response to actuation of the key-operable lockable latch of the tailgate in one direction by said key; (d) to unlock only the lockable latch of the driver's door in response to selective actuation of the key-operable lockable latch of the driver's door in said opposite direction by said key; (e) and to unlock only the key-operable lockable latch of the tailgate in response to actuation of the key-operable lockable latch of the tailgate in the opposite direction by said key.

In a preferred embodiment of the present invention, the selective actuation of the key-operable lockable latch of the driver's door mechanically unlocks only that door, and actuation of the key-operable lockable latch of the tailgate in said opposed direction also mechanically unlocks only the tailgate.

In such a preferred embodiment of the invention, each key-operable lockable latch includes a rotatable key barrel incorporating a multi-position switch mechanism, and the key, when inserted into said key barrel, can only rotate said barrel into each position of the switch mechanism against a spring bias, which spring bias increases sharply as the key moves the barrel between sequential positions in the same direction from an insertion position of the key. Consequently, the driver of the vehicle can detect immediately this increase in bias as the key moves within the barrel between switching positions, and thus can readily determined which switch position he wants to select.

The preferred embodiment of the invention additionally provides lockable latches having a "superlock" feature. By the term "superlock", we mean the structural feature within such lockable latches whereby a portion of the latch mechanism or the actuator therefor can be physically moved into a position in which it renders the inter-engageable movable elements of the locking mechanism effectively immovable. Once such a "superlock" feature is activated in the lockable latch, the lockable latch cannot be moved to an unlatched position until the "superlock" feature has been deactivated. An advantageous feature of the preferred embodiment of the present invention is that the key-operable lockable latch on the driver's door can be actuated by the key to "superlock" all of the doors of the vehicle. A suitable actuator for providing a "superlock" feature to a lockable latch is disclosed in and claimed in our co-pending U.S. patent application Ser. No. 838,697, filed by Gary C. Fulks et al. on Mar. 12, 1986, issued as U.S. Pat. No. 4,727,301 on Feb. 23, 1988, and based on a British patent application 8507354.

Preferably the centralised door-locking system is one in which the key-operable lockable latch on the tailgate can also be actuated by said key to unlock all of the lockable latches of the doors of the vehicle.

In the preferred embodiment of the present invention, the front passenger's door of the vehicle is also provided with a key-operable lockable latch which is operable by said key to lock/unlock all of the lcokable latches of the doors of the vehicle, depending upon the direction of rotation of the key within said key-operable lockable latch of the front passenger's door.

Advantageously, all of the lockable latches on the doors of the vehicle are provided with manually-operable means to enable the locking/unlocking of each lockable latch by manual operation of a movable member mounted on the respective door and readily accessible from the interior of the vehicle, and the system includes a switch means inside the vehicle adjacent to the driver's door which can be manually operated to cause the door-locking system to lock/unlock all of the lockable latches of the doors and the tailgate. The provision of such a switch means readily accessible to the driver of the vehicle allows the driver of the vehicle to lock/unlock all of the doors of the vehicle substantially simultaneously if circumstances arise which make this desirable. Preferably in such a system, manual operation in one direction of the door-mounted movable member of the lockable latch of the front passenger door causes the door-locking system to unlock all of the lockable latches of the doors and the tailgate. If desired, it could also be arranged for the manual operation of said door-mounted movable member of the lockable latch of the front passenger door in the opposite direction to cause the door-locking system to lock all of the lockable latches of the door and the tailgate.

DESCRIPTION OF THE PREFERRED EMBODIMENT

Figure 1:
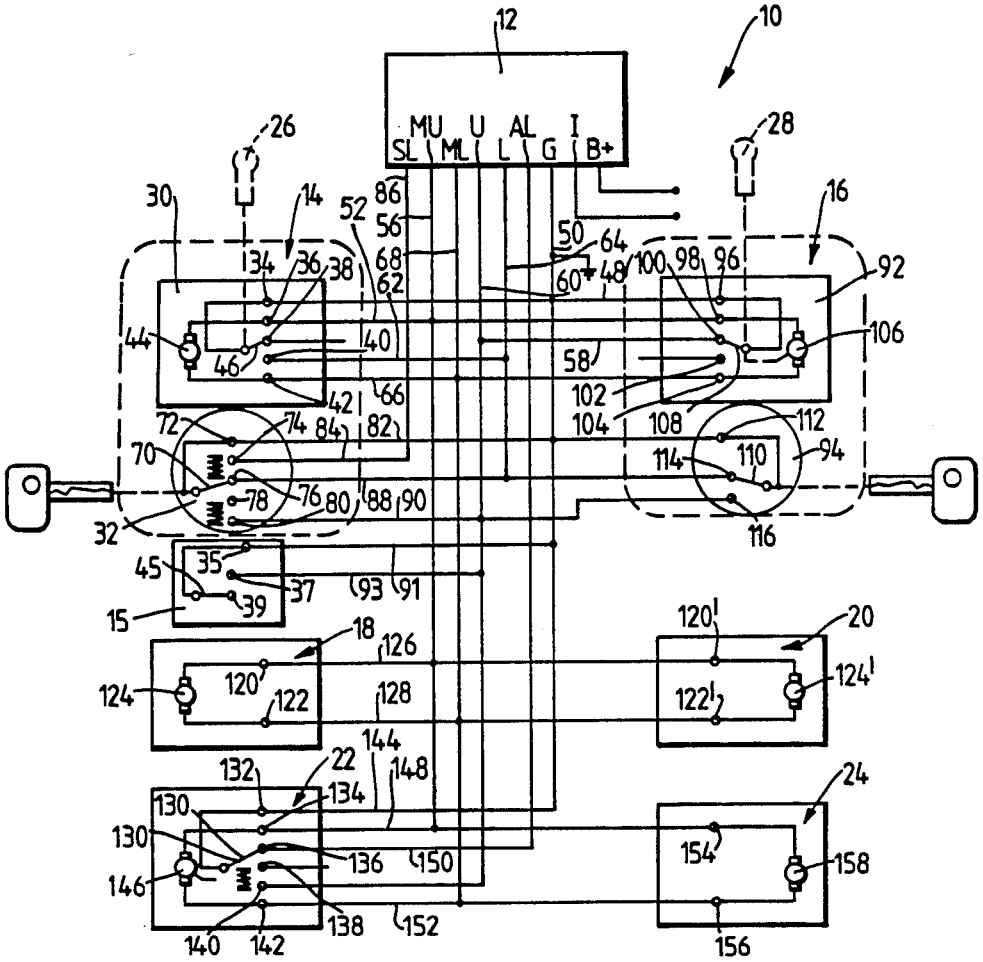
FIG. 1 is a schematic view of a switchable actuation system of a centralised door-locking system according to a first preferred embodiment of the present invention.

As can be seen from FIG. 1 of the accompanying drawings, a switchable actuation system 10 comprises an electronic controller 12, a motor-driven actuator 14 installed in a driver's door of a motor vehicle, a two-position switch 15 provided inside the vehicle adjacent the driver's door in a position readily accessible by the driver from the driving seat of the vehicle, a motor-driven actuator 16 installed in a front passenger's door of the motor vehicle, a motor-driven actuator 18 installed in a left hand rear door of the motor vehicle, a motor-driven actuator 20 installed in a right hand rear door of the motor vehicle, a motor-driven actuator 22 installed in a tailgate of the motor vehicle, and a motor-driven actuator 24 installed on a pivoted cover of a fuel tank for the motor vehicle. Each one of the motor-driven actuators 14, 16, 18 and 20 forms part of a lockable latch mechanism (not shown) for the respective door in which it is mounted. Each one of these lockable latches is provided with the customary external and internal manually-operable members for latching/unlatching of the lockable latch, and are also provided with manually-operable members located upon the interior surface of the respective door, such as an internal window sill button, for locking the lockable latch mechanism from inside the motor vehicle. The manually-operable internal locking member for each of the lockable latches locks the lockable latch mechanically. In addition, the manually-operable internal locking member 26 associated with the driver's door of the motor vehicle is mechanically connected to switching members in actuator 14, and the manually-operable internal locking member 28 associated with the front passenger's door is similarly mechanically connected to switching components in actuator 16.

Motor-driven actuator 14 is a key-operable actuator including a mechanically-operable "superlock" feature, as hereinbefore defined. Motor-driven actuator 16 is a key-operable actuator including an electrically-operable "superlock" feature, as hereinbefore defined. A suitable motor-driven actuator with a "superlock" feature is disclosed in and claimed in the aforementioned U.S. Pat. No. 4,727,301, the disclosure in which is incorporated herein by reference thereto. Actuators 14 and 16 are master actuators incorporating internal switches for controlling the actuation of the other motor-driven actuators of the centralised door-locking system of the invention, including actuators 18, 20, 22 and 24. Motor-driven actuators 18 and 20 are similar in structure to the actuator 16, except that they lack these internal switches. Motor-driven actuator 22 in the tailgate of the vehicle does not possess the "superlock" feature of actuators 14, 16, 18 and 20, and is thus of a somewhat simpler construction. A suitable motor-driven actuator for this purpose is disclosed in and claimed in our co-pending British patent application No. 8412861, published as GB 2 159 001A, the disclosure in which is incorporated herein by reference thereto. Actuator 22 is also a master actuator incorporating an internal switch for controlling the other motor-driven actuators present in the centralised door-locking system. Motor-driven actuator 24 is similar in structure to actuator 22, except that it lacks the internal switch for controlling the other motor-driven actuators in the centralised door-locking system.

Turning now to the detailed consideration of the actuator 14 in the driver's door of the motor vehicle, this includes a motor switch circuit 30 and a rotatable key barrel 32. Motor switch circuit 30 includes terminals 34, 36, 40 and 42, each one of which is connected to the electronic controller 12. An electric motor 44 of the actuator 14 is connected across terminals 36 and 42, and terminal 34 is connected to a terminal of an internal switch 46, which is mechanically coupled to the manually-operable internal locking member 26, as is shown by the dotted line connection. Internal switch 46 can be moved by the internal locking member 26 so as to connect terminal 34 with either terminal 38 or terminal 40 of the motor switch circuit 30.

Terminal 34 is connected to a terminal G on electronic controller 12 via lines 48 and 50, line 50 also being connected to a source of ground potential. Terminal 36 is connected via lines 52 and 56 to terminal MU of electronic controller 12. Terminal 40 is connected via lines 62 and 64 to terminal L of electronic controller 12. Terminal 38 is not connected to electronic controller 12 in any way. Finally, terminal 42 of motor switch circuit 30 is connected via lines 66 and 68 to terminal ML of electronic controller 12.

Key barrel 32 of actuator 14 contains a four-position switch 70 having terminals 72, 74, 76, 78 and 80. Terminal 72 is connected to line 50 through line 82, so as to supply ground potential to four-position switch 70. Terminal 74 is connected via lines 84 and 86 to terminal SL of electronic controller 12, and terminal 76 is connected via lines 88 and 64 to terminal L of electronic controller 12. Terminal 78 is not connected to anything, and terminal 80 is connected via lines 90 and 60 to terminal U of electronic controler 12. The four-position switch 70 in key barrel 32 is spring-biased in both directions of movement by spring means, only two of which are shown schematically in FIG. 1. A more detailed explanation of the spring-biasing of key barrel 32 will be given hereinafter with reference to FIG. 2 of the drawings.

The two position switch 15 includes terminals 35, 37 and 39, with a movable switch member 45 of the switch 15 being movable from disconnected terminal 39 into switching contact with terminal 37 to unlock all of the doors of the vehicle. As can be seen in FIG. 1 of the drawings, terminal 35 is connected to line 50 via line 91, and terminal 37 is connected to line 60 via line 93.

Motor-driven actuator 16 in the front passenger's door of the motor vehicle is of similar construction to actuator 14, in that it has a motor switch circuit 92 and a rotatable key barrel 94 having features rather similar to the switch circuit 30 and the key barrel 32 of actuator 14. Thus, switch circuit 92 has terminals 96, 98, 100, 102, and 104, with an electric motor 106 for the actuator 16 being coupled between terminals 98 and 104. Terminal 96 is connected to ground potential through lines 48 and 50, and is also connected to an internal switch 108 which is mechanically connected to the manually-operable internal locking member 28 of the front passenger's door. The internal locking member 28 can be used to move the internal switch 108 so as to connect terminal 96 with either terminal 100 or terminal 102. Terminal 98 is connected to line 52, terminal 100 is connected to line 58 and terminal 104 is connected to line 66. Terminal 102, however, is not connected to electronic controller 12 in this particular embodiment of the present invention.

Turning now to the rotatable key barrel 94 of actuator 16, this includes a two-position switch 110 having three terminals 112, 114 and 116. Terminal 112 is connected via lines 82 and line 50 to a source of ground potential, and supplies this ground potential to two-position switch 110. Two-position switch 110 can be moved by the insertion of a key in the key barrel and rotation of the key barrel to move between a position in which the two-position switch 110 connects terminal 114 to terminal 112 and a position in which the two-position switch 110 connects the terminal 116 to terminal 112. Terminal 114 is connected via line 88 to line 64, and terminal 116 is connected to line 90, and thus to line 60 from the controller.

Motor-driven actuators 18 and 20, mounted in the rear doors of the motor vehicle, operate as slave actuators under the control of the master actuators 14 and 16, as will be described in detail hereinafter. Consequently, the switch circuit arrangement for each of these actuators is the same, and they are connected in the switchable actuation system 10 in a similar fashion. Consequently, only the connections for actuator 18 will be described, on the basis that the connections for actuator 20 are exactly the same. In actuator 18, there are two terminals 120 and 122, connected to one another through an electric motor 124 which constitutes the motor drive for the actuator. Terminal 120 is connected to line 56 via line 126, and terminal 122 is connected to line 68 via line 128.

Motor-driven actuator 22 located in the tailgate of the vehicle forms part of a key-operable lockable latch of the tailgate. The switch circuit of this actuator 22 contains a three-position switch 130 and six separate terminals 132, 134, 136, 138, 140 and 142. Terminal 132 is connected via lines 144 and 50 to the source of ground potential, and supplies this ground potential to the three-position switch 130. An electric motor 146, which comprises the motor drive for the actuator 22, is coupled across terminals 134 and 142, and terminal 134 is connected to line 56 via line 148. Terminal 136 is connected via a line 150 to terminal AL of electronic controller 12. Terminal 138 is not connected to electronic controller 12, and terminal 140 is connected to line 60. Finally, terminal 142 is connected to line 68 via a line 152. Three-position switch 130 is spring-biased in its switching positions, as shown schematically in FIG. 1, and these switching positions wil be described in more detail hereinafter with reference to FIG. 3 of the accompanying drawings.

Finally, on FIG. 1 of the accompanying drawings, the motor-driven actuator 24, mounted in the pivoted cover which covers the fuel-filler aperture for the fuel tank of the motor vehicle, is a slave actuator having a switch circuit very similar to actuators 18 and 20. Thus, the switch circuit of actuator 24 includes two terminals 154 and 156, across which is connected an electric motor 158 which constitutes the motor drive for the actuator 24. Terminal 154 is connected to line 148, and terminal 156 is connected to line 152.

Figure 2:
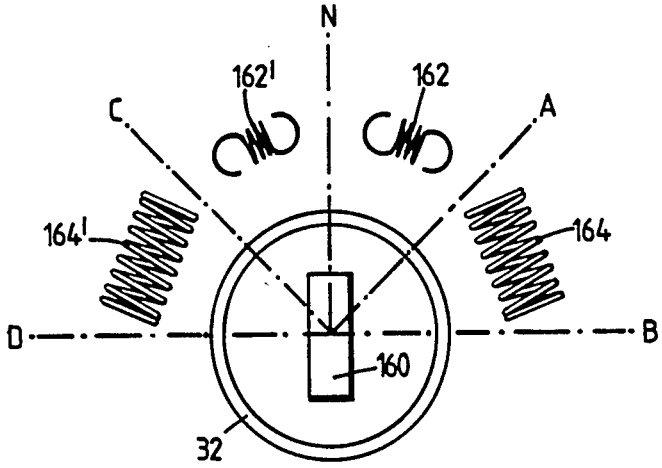
FIG. 2 is a schematic representation of a suitable key barrel for use in a driver's door of a motor vehicle incorporating the switchable actuation system shown in FIG. 1.

FIG. 2 of the accompanying drawings represents a schematic end view of the rotatable key barrel 32 of the lockable latch in the driver's door of the motor vehicle. The key barrel 32 includes a key slot aperture 160, into which is insertable the appropriate key for the latchable lock mechanism, whereby the key barrel 32 can be rotated from a central position designated by the letter N into four others positions designated by the letters A, B, C and D respectively. When the key slot 160 is in the position N, four-position switch 70 has the movable switch member thereof located between terminals 76 and 78. The key barrel 32 is biased with the key slot 160 in positions N by coil springs 162, 162' located between positions A and C, respectively. Thus movement of the key slot 160 from position N to position A compresses coil spring 162, and the spring bias exerted by this spring 162 is sufficient to return the key slot 160 to position N once the turning force on the key in the key slot 160 is released. Spring 162' provides a similar spring bias against movement of the key slot 160 from position N to position C.

Further movement of the key slot 160 from position A to position B is resisted by a helical spring 164, which helical spring 164 exerts a far stronger spring bias against this movement than does the spring 162. Similarly, there is a helical spring 164' positioned to oppose movement of the key slot 160 from position C to position D. When the key slot 160 is in position A, this corresponds to the four-position switch 70 connecting terminals 78 and 72. When key slit is moved from position A to position B against the bias of helical spring 614, the four-position switch 70 connects terminal 80 with terminal 72. When key slot 160 is moved to position C, the four-position switch 70 connects terminal 76 to terminal 72, and when key slot 160 is moved from position C to position D, against the spring bias exerted by helical spring 164', four-position switch 70 connects terminal 74 to terminal 72. The key can only be removed from key slot 160 if the key slot 160 is in position N or in position D.

Figure 3:
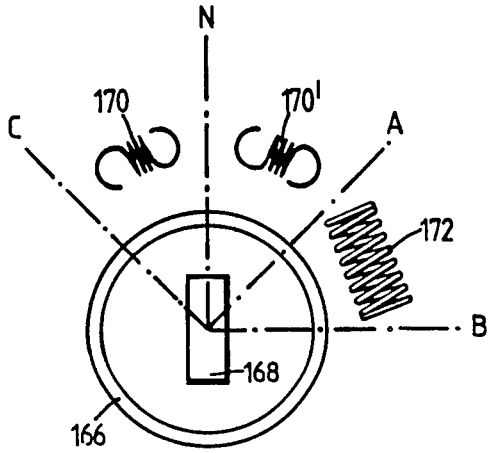
FIG. 3 is a schematic representation of a suitable key barrel for use in a tailgate of a motor vehicle incorporating the switchable actuation system shown in FIG. 1.

FIG. 3 of the accompanying drawings shows a schematic end view of a rotatable key barrel 166 of the lockable latch of the tailgate which includes motor-driven actuator 22. Key barrel 166 includes a key slot aperture 168, into which can be inserted the appropriate key in order to rotate the key slot 168 from a position indicated by the letter N leftwards, as seen in FIG. 3, to a position indicated as C, against the bias of a coil spring 170. Key slot 168 can be rotated rightwardly, as seen in FIG. 3, from the position N into a position shown by A against the bias of a similar coil spring 170'. Key slot 168 can be rotated from the position A further rightwards into a position shown by the letter B against the bias of a much stronger helical spring 172 than the spring 170'. The rotatable key barrel 166 is connected to the three-position switch 130 in actuator 22, with the movable switch member of this switch being positioned between terminals 136 and 138 when the key slot is in the position N. Movement of the key slot 168 from position N into position C results in the three-position switch 130 connecting terminal 136 to terminal 132. Rotation of the key slot 168 in the opposite direction from position N into position A results in the three-position switch 130 connecting terminal 138 to terminal 132. Finally, when the key slot 168 is rotated from position A into position B against the bias of helical spring 172, three-position switch 130 connects terminal 140 to terminal 132.

Figure 4:
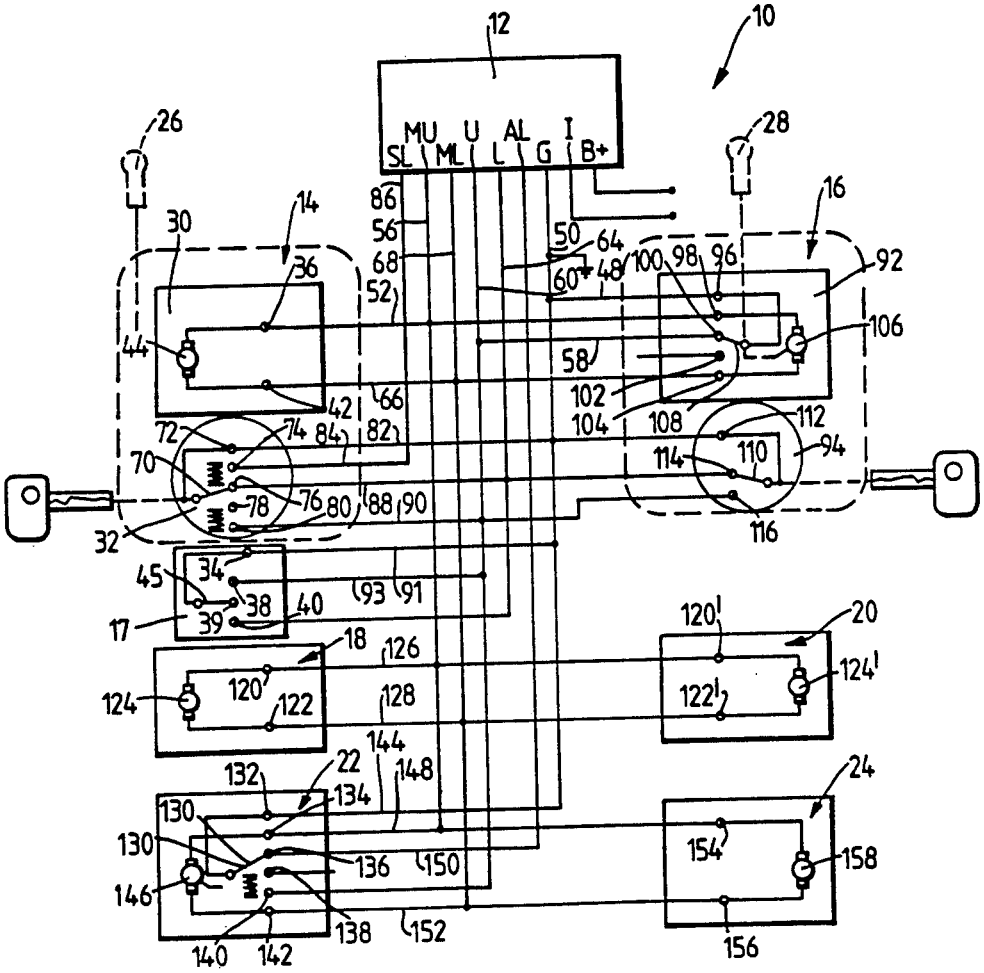
FIG. 4 is a schematic view of a switchable actuation system of a centralised door-locking system according to a second preferred embodiment of the present invention.

A second preferred embodiment of the invention is illustrated in the switchable actuation system shown in FIG. 4 of the drawings. In the switchable actuation system shown in FIG. 4, the same reference numbers are used to designate similar components as those shown in FIG. 1 of the drawings. The motor-driven actuator 14 in the driver's door has been modified so that the operation of the internal locking member 26 will lock/unlock mechanically only the lockable latch in the driver's door. Additionally, a three-position switch 17 is provided inside the vehicle adjacent the driver's door in a position readily accessible by the driver from the driving seat of the vehicle. This three-position switch 17 includes the terminals 34, 38 and 40 previously located in the motor switch circuit 30 of FIG. 1, with a movable switch member 45 of the switch 17 being movable from a disconnected terminal 39 into switching contact with either terminal 38, to unlock all of the doors of the vehicle, or terminal 40, to lock all of the doors of the vehicle. As can be seen in FIG. 4 of the drawings, terminal 34 is connected to line 50 via line 91, terminal 38 is connected to line 60 via line 93, and terminal 40 is connected to line 64 via line 95.

OPERATION OF THE SWITCHABLE ACTUATION SYSTEM

The operation of the switchable actuation system 10 of the centralised door-locking system of the present invention will now be described with reference to FIGS. 1 to 3. Referring first to FIG. 1, electronic controller 12 has 10 terminals thereon, indicated in FIG. 1 by the reference letters SL, MU, ML, U, L, AL, G, I and B+. SL indicates "superlock" activated. MU indicates motor unlock, and ML represents motor lock. U indicates unlock signal, and L indicates lock signal. AL indicates auxiliary lock signal. G indicates ground signal, I indicates ignition switch lead, and B+ indicates battery lead.

Consider now the situation where all doors of the vehicle are unlocked, along with the tailgate and the pivoted cover to the fuel tank. Each of the rear doors of the motor vehicle can be locked by manipulation of the respective internal locking members. Similarly, the front passenger's door can be locked mechanically by manipulation of internal locking member 28. During the locking of this door, the internal switch 108 connects terminal 102 to terminal 96, but this has no effect upon the switchable actuation system 10 since terminal 102 is not connected to electronic controller 12.

The driver's door of the motor vehicle can be locked mechanically by manipulation of the internal locking member 26, and this will result in the internal switch 46 disconnecting terminal 38 from terminal 34, and connecting terminal 40 to terminal 34. Since terminal 34 is connected to the source of ground potential, this means that terminal 40 and lines 62 and 64 fall to ground potential. This produces a ground potential signal at terminal L on electronic controller 12, and electronic controller 12 reacts to this signal to generate a positive signal at terminal ML which causes electric motors 44, 106, 124, 124', 146 and 158 to start up and move the associated lockable latches to their locked positions.

Manipulation of the internal locking member 28 to cause internal switch 108 to connect terminal 100 to terminal 96 will result in a ground potential signal being produced at terminal U of electronic controller 12. Similarly, movement of the movable switch member 45 of two-position switch 15 into contact with terminal 37 will also result in this gorund potential signal being produced at terminal U of electronic controller 12. Electronic controller 12 reacts to this ground potential signal on terminal U to generate a positive signal on terminal MU, which causes the electric motors 44, 106, 124, 124', 146 and 158 to rotate in the opposite direction in order to unlock the respective lockable latches.

In the alternative arrangement of the switchable actuation system 10 shown in FIG. 4, manipulation of the internal locking member 26 of the lockable latch associated with actuator 14 will cause only the mechanical locking/unlocking of the latch. In this alternative embodiment, the separate switch 17 is provided inside the vehicle adjacent to the driver's door, and is coupled between terminal G of electronic controller 12 and terminals U and L. This switch 17 can be manually operated to cause the actuators 14, 16, 18, 20, 22 and 24 to lock/unlock all of the lockable latches of the doors and the tailgate substantially simultaneously.

Consider now the situation where a driver of the vehicle parks the vehicle, and leaves the vehicle He can lock the vehicle from the driver's door by the insertion of the appropriate key within the key slot 160 of the rotatable key barrel 32 and turning the key slot 160 from position N into position C, so connecting terminal 76 to terminal 72 through four-position switch 70. This produces a ground potential signal at terminal L of electronic controller 12, which results in a positive signal being generated at terminal ML of electronic controller 12, which switches on motors 44, 106, 124, 124', 146 and 158 to drive all of the associated lockable latches into a locked state. If the driver of the vehicle desires to make the vehicle as secure as possible from possible theft or entry thereto, he can choose to turn the key slot 160 further leftwards, as shown in FIG. 2, so as to move from position C into position D, against the strong bias of helical spring 164'. This further movement of key slot 160 mechanically "superlocks" the lockable latch of the driver's door and results in terminal 74 being coupled to terminal 72 through four-position switch 70, thus generating a ground potential signal at terminal SL of electronic controller 12. The electronic controller 12 responds to this ground potential signal on terminal SL to create an appropriate signal on the terminals MU and ML which will cause the motors 106, 124 and 124' to drive the associated actuators into the "superlock" position. The driver of the vehicle can then withdraw the key from the key slot 160 when it is in position D without difficulty, and can leave the vehicle in this "superlock" position.

Alternatively, the driver can, if he wishes, lock the vehicle by inserting the key in the rotatable key barrel 94 of the lockable latch of the front passenger's door, and rotating the key so as to connect terminal 114 with terminal 112 through two-position switch 110. Again, this generates a ground potential signal on terminal L of electronic controller 12, which, in turn, produces a positive signal on terminal ML to cause the motors 44, 106, 124, 124', 146 and 158 to move the associated lockable latches into a locked condition. The driver, however, cannot place the lockable latches in the vehicle doors into a "superlock" position from the locking of the front passenger's door.

The driver of the vehicle may decide, however, after parking the vehicle and leaving it, to remove luggage from the luggage compartment of the motor vehicle. Once he has done this and closed the tailgate of the vehicle, he can insert the appropriate key into the key barrel 166 of the tailgate lockable latch, and turn the key therein until the key slot 168 moves from position N shown in FIG. 3 to position C shown in FIG. 3. This results in terminal 136 being connected to terminal 132 through three-position switch 130, which generates a ground potential signal on terminal AL of electronic controller 12. Electronic controller 12 reacts to this ground potential signal on terminal AL by generating a positive signal on terminal ML. Once again, this positive signal on terminal ML of electronic controller 12 will cause the motors of the actuators to drive the associated lockable latches into a locked condition. Consider now the situation when the driver of the vehicle returns to the locked vehicle in its parking place. With the centralised door-locking system of the present invention, he has a number of choices available to him with regard to how he unlocks the vehicle, and to what extent he unlocks the vehicle. Thus, for example, he may be carrying luggage which he would prefer to place in the luggage compartment of the vehicle before unlocking the vehicle. To do this, he inserts the appropriate key in key slot 168 of the lockable latch of the tailgate, and turns that key from the position N into the position A against the bias of coil spring 170', as shown in FIG. 3. This movement of the key and key slot 168 mechanically unlocks the tailgate lockable latch, and places terminal 138 in contact with terminal 132 via three-position switch 130 in actuator 22. Since terminal 138 is not connected to electronic controller 12, the remainder of the motor vehicle remains securely locked, thus preventing any third party from gaining access to the vehicle for any nefarious purpose. Once having loaded the luggage into the luggage compartment of the vehicle, the driver could close the tailgate, and then proceed to the driver's door in order to unlock the remainder of the vehicle.

Alternatively, he can, if he wishes, unlock all of the remaining doors of the vehicle, provided they have not been "superlocked", by inserting the appropriate key into key slot 168 of the lockable latch of the tailgate, and turning the key and key slot 168 from the position N into the position B, as shown in FIG. 3, against first the bias of coil spring 170' and, second, the bias exerted by the helical spring 172. Once the key and key slot 168 reaches the position B, as shown in FIG. 3, terminal 140 is connected to terminal 132 in actuator 22, thus generating a ground potential signal at terminal U of electronic controller 12. This will result in a positive signal being generated on terminal MU of electronic controller 12, which signal causes motors 44, 106, 124, 124', 146 and 158 to move their respective lockable latches to the unlocked position. Since the lockable latch of the tailgate is already in the unlocked position, the energisation of motor 146 does not produce any change in the position of this lockable latch.

If the driver of the vehicle decides to unlock the vehicle from the driver's door, he can choose, if he wishes, just to unlock the driver's door, whilst leaving all of the other doors and the tailgate of the vehicle fully secured. To do this, the driver inserts the appropriate key into the key slot 160, and commences turning the key slot 160 clockwise, as seen in FIG. 2 of the drawings. If the motor vehicle has been parked with the lockable latches of the door in the "superlock" position, the key slot 160 will be aligned in the direction corresponding to position D as shown in FIG. 2. Consequently, once the driver inserts the key into the key slot 160 and commences turning the key clockwise, the bias exerted upon the key and key slot 160 by the helical spring 164' will rotate the key slot 160 into alignment with position N of FIG. 2. If the driver continues to turn the key and key slot 160 clockwise from position N to position A of FIG. 2, this movement mechanically unlocks the lockable latch of the driver's door. During this movement, terminal 78 of the rotatable key barrel 32 is connected to terminal 72 through four-position switch 70, but, since terminal 78 is not connected to electronic controller 12, the remaining doors of the vehicle and the tailgate remain in their locked positions. If the motor vehicle has been left parked with the lockable latches of the doors in the "superlock" condition, then the movement of the key slot 160 fo the rotatable barrel 32 between position D and position N of FIG. 2 encompasses position C of FIG. 2, and this movement produces signals to electronic controller 12 which cause motors 44, 106, 124 and 124' to move the respective lockable latches from the "superlock" position back to the normal locked position. Having mechanically unlocked only the driver's door, the driver can now, if he wishes, open the driver's door of the vehicle, enter the vehicle and drive the vehicle away, secure in the knowledge that all of the remaining doors of the vehicle and the tailgate of the vehicle are securely locked.

Alternatively, the driver of the vehicle can choose, if he wishes, to unlock all of the vehicle doors and the tailgate of the vehicle from the driver's door before he enters the vehicle, so as to provide immediate access to the vehicle by any companions travelling with him. To do this, he inserts the appropriate key into the key slot 160, and turns the key and key slot 160 clockwise, as shown in FIG. 2, until the key slot 160 registers with position B of FIG. 2. In this position of key slot 160, terminal 80 of the rotatble key barrel 32 is connected to terminal 72 through four-position switch 70, thus placing a ground potential signal on the terminal U of electronic controller 12. Electronic controller 12 responds to this signal by generating a positive signal on terminal MU which directs the motors 44, 106, 124, 124', 146 and 158 to move the respective lockable latches to the unlocked positions.

A centralised door-locking system according to the present invention presents an effective way of providing a motor-vehicle with all the assets and advantages associated with conventional centralised door-locking systems in motor vehicles allied with the ability to selectively lock/unlock the driver's door and the tailgate of the vehicle.

The modification of the switchable actuation system of the invention illustrated in FIG. 4 of the drawings has the useful additional feature of providing the driver of the vehicle with a means of easily locking/unlocking all of the doors of the vehicle and the tailgate substantially simultaneously whilst driving the vehicle.

We claim:

1. A centralised door locking system in a motor vehicle having a door for a driver of the vehicle, one or more doors providing access for passengers in the vehicle, and a tailgate providing access to a luggage compartment of the vehicle, in which system lockable latches are provided on all of the doors and on the tailgate, and lockable latches on the driver's door and the tailgate being key-operable lockable latches, and said lockable latches are interconnected by a switchable actuation system;

the lockable latch on the driver's door having a key movable member effective to actuate the lockable latch on the driver's door between locked and unlocked conditions and further effective to activate a first multi-position switch connected in the switchable actuation system, the key movable member of the lockable latch on the driver's door being movable from an unbiased position in one direction by key rotation against a first bias to a first biased position in which the lockable latch on the driver's door is actuated to an unlocked condition and further movable in the one direction against a second bias far stronger than the first bias to a second biased position in which the first multi-position switch is actuated to condition the switchable actuation system to unlock all of the lockable latches and further being movable from the unbiased position in the opposite direction against a third bias to a third biased position in which the first multi-position switch is actuated to condition the switchable actuation system to lock all the lockable latches;

the lockable latch on the tailgate having a key movable member effective to actuate the lockable latch on the tailgate between locked and unlocked conditions and further effective to activate a second multi-position switch connected in the switchable actuation system, the key movable member of the lockable latch on the tailgate being movable from an unbiased position in one direction by key rotation agianst a fourth bias to a fourth biased position in which the second multi-position switch is actuated to condition the switchable actuation system to lock all the lockable latches and further being movable in the opposite direction against a fifth bias to a fifth biased position in which the lockable latch on the tailgate is actuated to the unlocked condition.

2. The centralised door locking system of claim 1 in which the key movable member of the lockable latch on the tailgate is further movable in the opposite direction against a sixth bias far stronger than the fifth bias to a sixth biased position in which the second multi-position switch is actuated to condition the switchable actuation system to unlock all of the lockable latches.

3. The centralised door locking system of claim 1 in which the lockable latch of at least one of the doors providing access for passengers has a key-operable lockable latch interconnected in the switchable actuation system and having a key movable member effective to actuate the lockable latch on the one of the doors providing access for passengers between locked and unlocked conditions and further effective to activate a third multi-position switch connected in the switchable actuation system, the key movable member of the lockable latch on the one of the doors providing access for passengers being movable by key rotation to a lock position in whcih the third multi-position switch is actuated to condition the switchable actuation system to lock all of the lockable latches and further movable to an unlock position in which the third multi-position switch is actuated to condition the switchable actuation system to unlock all of the lockable latches.

4. The centralised door locking system of claim 1 further including interior individually operable manual means for locking and unlocking the lockable latches of at least some of the vehicle doors and an interior switch adjacent the driver's door and interconnected in the switchable actuation system, the interior switch being manually actuatable to an interior switch lock position in which the switchable actuation system is conditioned to lock all of the lockable latches and further manually actuatable to an interior switch unlock position in which the switchable actuation system is conditioned to unlock all the lockable latches.

5. The centralised door locking system of claim 1 further including a pivoted cover for a fuel tank of the vehicle, the pivoted cover further having a lockable latch which is locked and unlocked along with those on the vehicle doors by the door locking system.

* * * * *